US012339039B2

(12) United States Patent
Vie

(10) Patent No.: US 12,339,039 B2
(45) **Date of Patent: *Jun. 24, 2025**

(54) SPARK IGNITION MODULE AND METHODS

(71) Applicant: Copeland Comfort Control LP, St. Louis, MO (US)

(72) Inventor: David L. Vie, Union, MO (US)

(73) Assignee: Copeland Comfort Control LP, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/773,016

(22) Filed: Jul. 15, 2024

(65) Prior Publication Data

US 2024/0369261 A1 Nov. 7, 2024

Related U.S. Application Data

(63) Continuation of application No. 16/853,095, filed on Apr. 20, 2020, now Pat. No. 12,050,030.

(51) Int. Cl.
*F24D 19/10* (2006.01)
*F24D 5/00* (2022.01)
(Continued)

(52) U.S. Cl.
CPC ..... *F24H 9/2085* (2013.01); *F24D 5/00* (2013.01); *F24H 15/208* (2022.01); *F24H 15/254* (2022.01); *F24H 15/281* (2022.01); *F24H 15/31* (2022.01); *F24H 15/36* (2022.01); *F24H 15/421* (2022.01); *F24H 15/464* (2022.01); *F23N 1/025* (2013.01); *F23N 2227/02* (2020.01); *F23N 2237/00* (2020.01); *F23N 2241/02* (2020.01); *F23N 2900/05005* (2013.01); *F24D 2200/04* (2013.01); *F24D 2220/042* (2013.01); *F24H 15/20* (2022.01); *F24H 15/242* (2022.01);
(Continued)

(58) Field of Classification Search
CPC .... F24D 19/1084; F24D 5/00; F24D 2200/04; F24D 2200/042; F23N 2241/02; F23N 2237/00; F23N 2227/02; F23N 2227/08; F23N 1/025; F23N 1/002; F23N 1/022; F23N 1/042; F23N 2900/05005; F23N 2900/05004
See application file for complete search history.

(56) References Cited

U.S. PATENT DOCUMENTS 4,373,662 A 2/1983 Bassett et al.
4,421,268 A 12/1983 Bassett et al.
(Continued)

FOREIGN PATENT DOCUMENTS

EP 0050287 A2 4/1982

*Primary Examiner* — Ko-Wei Lin
(74) *Attorney, Agent, or Firm* — Armstrong Teasdale LLP

(57) ABSTRACT

A controller for use in a gas appliance system includes a circuit board, a plurality of connectors and a processor mounted on the circuit board. The processor controls operation of the gas appliance using, in part, at least one connector of the plurality of connectors and control settings for an intermittent pilot (IP) system in response to a user selection to configure the controller to control an IP system, and controls operation of the gas appliance using, in part, at least one connector of the plurality of connectors and control settings for a direct spark ignition (DSI) system in response to a user selection to configure the controller to control a DSI system.

20 Claims, 5 Drawing Sheets

(51) Int. Cl.

| | |
|---|---|
| ***F24H 9/20*** | (2022.01) |
| ***F24H 15/208*** | (2022.01) |
| ***F24H 15/254*** | (2022.01) |
| ***F24H 15/281*** | (2022.01) |
| ***F24H 15/31*** | (2022.01) |
| ***F24H 15/36*** | (2022.01) |
| ***F24H 15/421*** | (2022.01) |
| ***F24H 15/464*** | (2022.01) |
| *F23N 1/02* | (2006.01) |
| *F24H 15/20* | (2022.01) |
| *F24H 15/242* | (2022.01) |
| *F24H 15/258* | (2022.01) |
| *F24H 15/33* | (2022.01) |
| *F24H 15/395* | (2022.01) |

(52) U.S. Cl.
CPC ..... *F24H 15/258* (2022.01); *F24H 15/33* (2022.01); *F24H 15/395* (2022.01)

(56) References Cited

U.S. PATENT DOCUMENTS

| | | | | |
|---|---|---|---|---|
| 5,544,645 | A | 8/1996 | Armijo et al. | |
| 5,822,740 | A | 10/1998 | Haissig et al. | |
| 7,513,438 | B2 | 4/2009 | Mueller | |
| 8,074,892 | B2 | 12/2011 | Bracken et al. | |
| 9,689,569 | B2 * | 6/2017 | Vie | F23N 5/203 |
| 10,174,967 | B2 * | 1/2019 | Schneider | F24H 15/208 |
| 2004/0118932 | A1 | 6/2004 | Sanchez | |
| 2009/0287355 | A1 | 11/2009 | Milder et al. | |
| 2010/0075264 | A1 * | 3/2010 | Kaplan | F23N 5/242 431/42 |
| 2012/0221150 | A1 | 8/2012 | Arensmeier | |
| 2012/0232969 | A1 | 9/2012 | Fadell et al. | |
| 2016/0123588 | A1 | 5/2016 | Vie | |
| 2017/0211836 | A1 * | 7/2017 | Perez | F24H 15/156 |
| 2018/0363934 | A1 | 12/2018 | Vie et al. | |
| 2022/0034536 | A1 * | 2/2022 | Broker | F24H 15/36 |
| 2022/0034537 | A1 * | 2/2022 | Broker | F24H 15/31 |

* cited by examiner

SPARK IGNITION MODULE AND METHODS

CROSS-REFERENCE TO RELATED APPLICATION

This application is a continuation of U.S. patent application Ser. No. 16/853,095 filed Apr. 20, 2020, the contents of which are hereby incorporated by reference herein in their entirety.

FIELD

The field of the disclosure relates generally to gas-powered appliances, and more particularly, to spark ignition modules for use in gas-powered appliances.

BACKGROUND

Gas powered appliances (such as a gas powered furnace, a gas powered oven, a gas powered water heater, and the like) include a burner at which gas is burned. Some gas powered appliances include a standing pilot that is continuously lit and that is used to ignite gas at the burner when desired. Other gas powered appliances include a spark ignition module that ignites gas at the burner when desired without use of a standing pilot. Gas powered appliances using a spark ignition module are typically designed to either ignite the gas at the burner directly using direct spark ignition (DSI) or ignite a previously unlit pilot that then ignites the gas at the burner (referred to as intermittent pilot or IP). Different spark ignition modules are typically needed depending on whether the appliance uses DSI or IP, with each spark ignition module generally being configured for only IP or DSI.

In order to control ignition of gas at the burner, the spark ignition modules typically control the main gas valve to supply gas to the burner, control a spark ignitor, and (in IP systems) control a pilot valve to supply gas to the intermittent pilot. In addition to controlling the ignition of the gas at the burner, spark ignition modules may control other components and/or include other features. For example, some spark ignition modules can also control an inducer motor, may include one or more alarms, and may monitor a pressure switch. Configuring the spark ignition module to perform the various controls, alarms, and the like is typically performed on the spark ignition module using dipswitches, keys, buttons, or the like.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a controller for use in a gas appliance system includes a circuit board, a plurality of connectors mounted on the circuit board, and a processor mounted on the circuit board. The processor is programmed to control operation of the gas appliance using, in part, at least one connector of the plurality of connectors and control settings for an intermittent pilot (IP) system in response to a user selection to configure the controller to control an IP system, and to control operation of the gas appliance using, in part, at least one connector of the plurality of connectors and control settings for a direct spark ignition (DSI) system in response to a user selection to configure the controller to control a DSI system.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

For conciseness, examples will be described with respect to a gas powered furnace. However, the methods and systems described herein may be applied to any suitable gas powered appliance, including without limitation a gas powered dryer, a gas powered unitary or mobile heater, a gas powered boiler, a gas powered fryer, a gas powered water heater, and a gas powered oven.

Figure 1:
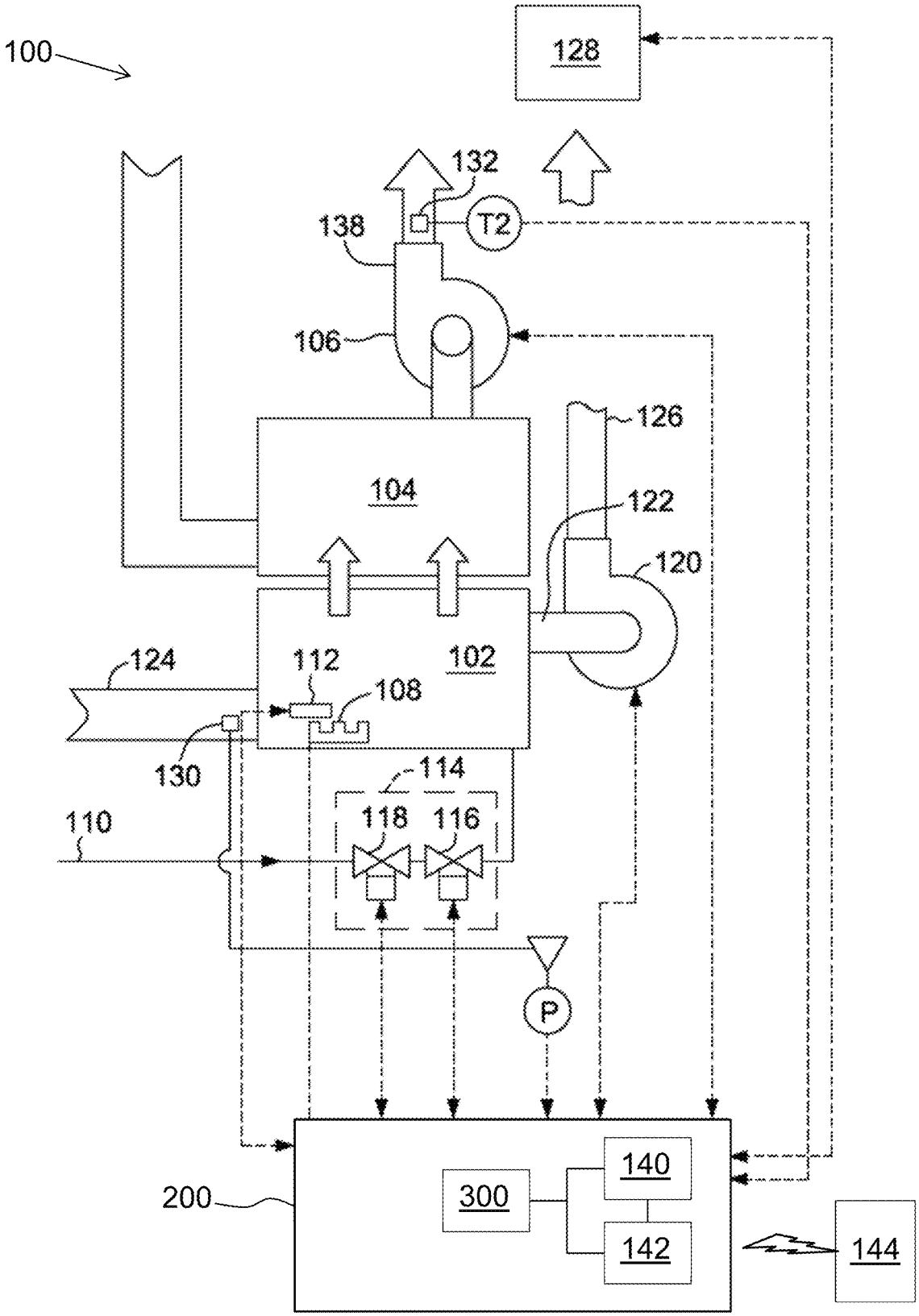
FIG. 1 is a schematic diagram of a gas furnace system including a furnace control system with a spark ignition controller.

Referring initially to FIG. 1, a gas furnace system of one embodiment for heating a temperature controlled environment is indicated generally at 100. The gas furnace system 100 generally includes a combustion chamber 102 for generating heat from combustible gases, a heat exchanger 104, and an air circulator 106 for circulating fluid (e.g., air) past the heat exchanger 104 to transfer heat generated by the combustion chamber 102 to the circulating fluid.

The combustion chamber 102 includes a burner assembly 108 connected to a gas fuel supply (not shown) via a gas inlet 110, and an ignition device 112, such as a hot surface ignitor, a spark ignitor, an intermittent pilot, or the like configured to ignite an air/fuel mixture within the combustion chamber 102. The burner assembly 108 includes one or more burners through which fuel gas is fed. The supply of fuel gas to the burner assembly 108 is controlled by a gas valve assembly 114, which, in the illustrated embodiment, includes a main burner valve 116 and a safety valve 118. In embodiments in which the ignition device 112 is an intermittent pilot, a supply of fuel gas to the intermittent pilot is controlled by a pilot gas valve (not shown).

An inducer blower 120 is connected to the combustion chamber 102 by a blower inlet 122. The inducer blower 120 is configured to draw fresh (i.e., uncombusted) air into the combustion chamber 102 through an air inlet 124 to mix fuel gas with air to provide a combustible air/fuel mixture. The inducer blower 120 is also configured to force exhaust gases out of the combustion chamber 102 and vent the exhaust gases to atmosphere through an exhaust outlet 126.

The combustion chamber 102 is fluidly connected to the heat exchanger 104. Combusted gases from the combustion chamber 102 are circulated through the heat exchanger 104 while the air circulator 106 forces air from the temperature controlled environment into contact with the heat exchanger 104 to exchange heat between the heat exchanger 104 and the temperature controlled environment. The air circulator 106 subsequently forces the air through an outlet 138 and back into the temperature controlled environment.

The operation of the system 100 is generally controlled by a furnace control system 200, which includes a safety system 140, a fan control 142, a spark ignition controller 300, and a thermostat 128 connected to the furnace control system 200. The thermostat 128 is connected to one or more temperature sensors (not shown) for measuring the temperature of the temperature controlled environment. The furnace control system 200 is connected to each of the gas valve assembly 114, the ignition device 112, the inducer blower 120, and the air circulator 106 for controlling operation of the components in response to control signals received from the thermostat 128. Generally, the fan control 142 controls operation of the air circulator 106 and inducer blower 120, and the safety system 140 monitors and protects against safety failures (such as failure of ignition during an attempt to light gas at the burner assembly 108). The spark ignition controller 300 controls the main gas valve, the pilot gas valve (if applicable), and the ignition device 112 to ignite gas at the burner assembly 108 when desired. The spark ignition controller 300 is also communicatively connected to a flame sensor 136 (shown in FIG. 2) that detects whether or not a flame has been ignited on the burner assembly 108 and/or on an intermittent pilot (where applicable). Moreover, in some embodiments, one or both of the safety system 140 and the fan control 142 are integrated with the spark ignition controller 300. A mobile device 144, such as a mobile phone, a tablet computing device, a laptop computing device, a smart watch, or the like, may be used for wireless communication with the spark ignition controller 300.

Figure 2:
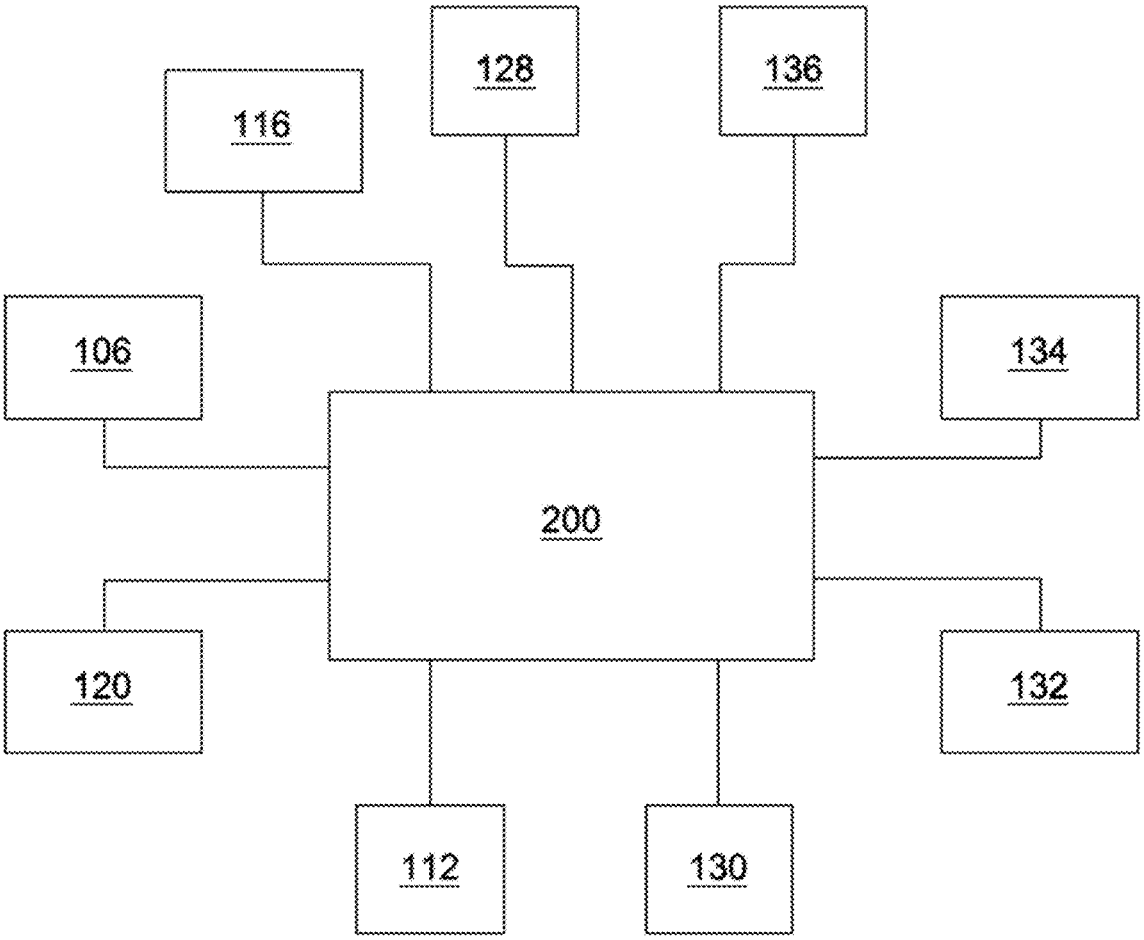
FIG. 2 is a block diagram of the furnace controller of FIG. 1 and component connections of the gas furnace system of FIG. 1.

With additional reference to FIG. 2, the system 100 includes a plurality of sensors and detectors for monitoring the environmental and operating conditions of the system 100. The illustrated furnace system includes a pressure sensor 130, a temperature sensor 132, a flame rollout detector 134, and a flame sensor 136. The furnace control system 200 is connected to each of the pressure sensor 130, the temperature sensor 132, the flame rollout detector 134, and the flame sensor 136, and is configured to control the furnace system 100 based on signals received from the sensors and detectors.

The pressure sensor 130 is configured to provide a pressure indication to the furnace control system 200 indicative of the pressure within the combustion chamber 102. In the example embodiment, the pressure sensor 130 includes an open/close switch that is opened when a detected pressure is below a threshold pressure limit and closed when a detected pressure is above the threshold pressure limit. In other suitable embodiments, the pressure sensor 130 includes an analog and/or digital sensor configured to output an analog and/or digital signal indicative of an actual or relative pressure to the furnace control system 200. In the illustrated embodiment, the pressure sensor 130 is positioned proximate the air inlet 124, and is configured to detect the pressure of fresh air being supplied to the combustion chamber 102. In other suitable embodiments, the pressure sensor 130 may be positioned at any suitable location within the furnace system 100 that allows the furnace system to function as described herein including, for example and without limitation, within the combustion chamber 102 and within the blower inlet 122.

The temperature sensor 132 is configured to provide a temperature indication to the furnace control system 200 indicative of a temperature T2 within the furnace system 100. In the example embodiment, the temperature sensor 132 includes an open/close switch that is opened when a detected temperature is above a threshold temperature limit and closed when a detected temperature is below the threshold pressure limit. In other suitable embodiments, the temperature sensor 132 includes an analog and/or digital sensor configured to output an analog and/or digital signal indicative of an actual or relative temperature to the furnace control system 200. In the illustrated embodiment, the temperature sensor 132 is positioned proximate the heat exchanger 104, and is configured to detect a high temperature condition within the heat exchanger 104. That is, the temperature sensor 132 is configured to communicate with furnace control system 200 to indicate the presence of a high temperature condition (e.g., a detected temperature above a threshold temperature limit) within the heat exchanger 104.

The flame rollout detector 134 is configured to detect a flame rollout condition within the furnace system 100, and communicate with the furnace control system 200 to indicate that a flame rollout condition has been detected. The term "flame rollout condition" refers to a condition in which the combustion of the air/fuel mixture occurs outside of the normal combustion area within the combustion chamber 102. For example, if the exhaust outlet 126 is impeded during operation, flames that are normally confined to an area immediately adjacent the burner assembly 108 may spread to other areas of the furnace system 100, such as outside the combustion chamber 102, creating a risk of damaging components of the furnace system 100. Flame rollout detector 134 is configured to detect a flame rollout condition to prevent abnormal operation of furnace system 100 and potential damage to components of the furnace system 100. The flame rollout detector 134 may include any suitable detectors and/or sensors that enable the flame rollout detector 134 to function as described herein including, for example and without limitation, temperature sensors, pressure sensors, and optical detectors. In the example embodiment, the flame rollout detector 134 includes an open/close switch that is opened when a flame rollout condition is detected, and closed when the flame rollout condition is no longer detected. In other suitable embodiments, the open/close switch may only be closed following the detection of a flame rollout condition with human intervention (e.g., by resetting the furnace control system 200).

The flame sensor 136 is configured to detect the presence of a flame at the burner assembly 108, and communicate with the furnace control system 200 to indicate the presence or absence of a flame. The flame sensor 136 may include any suitable sensor and/or detector for detecting the presence of a flame including, for example and without limitation, thermo-electric devices (e.g., thermopiles), and optical flame detectors. The flame sensor 136 is sometimes referred to as a remote flame sensor. Other embodiments use a local flame sensing capability, in which the flame is sensed through the spark probe (e.g. ignition device 112). In such embodiments, the ignition device 112 serves two functions, creating a spark and reading flame current.

Components of the furnace system 100, such as the main burner valve 116, the ignition device 112, the inducer blower 120, the pressure sensor 130, the temperature sensor 132, the flame rollout detector 134, and the flame sensor 136, may be electrically connected to the furnace control system 200 by one or more wiring harnesses. In one suitable embodiment, for example, the main burner valve 116, the pressure sensor 130, the temperature sensor 132, the flame rollout detector 134, and the flame sensor 136 are each electrically connected to the furnace control system 200 by a primary or main wiring harness, and the ignition device 112 and the inducer blower 120 are each electrically connected to the furnace control system 200 by a secondary wiring harness. A wiring harness is an assembly of cables or wires bound or secured together by suitable means including, for example and without limitation, straps, cable ties, cable lacing, sleeves, electrical tape, conduit, and combinations thereof. The wiring harnesses used to connect components of the furnace system 100 to the furnace control system 200 may include a harness connector adapted to mate with a complementary harness connector mounted on the furnace control system 200, described in more detail below. In one suitable embodiment, for example, a wiring harness of the furnace system 100 includes a male harness connector adapted to mate with a female harness connector mounted on the furnace control system 200.

In operation, the thermostat 128 transmits a call for heat to the furnace control system 200 (e.g., in the form of an electrical signal) when a detected temperature within the temperature controlled environment falls below a pre-determined temperature limit. Upon receiving a call for heat, the furnace control system 200 checks the environmental and operating conditions of the furnace system 100 using one or more of the pressure sensor 130, the temperature sensor 132, the flame rollout detector 134, and the flame sensor 136 to ensure the temperature, pressure, and/or other conditions of the furnace system 100 are within predetermined limits. In the example embodiment, the furnace control system 200 outputs a signal to each of the temperature sensor 132 and the flame rollout detector 134 to confirm that the open/close switch of each of the sensors is in the closed position.

Once the environmental and/or operational conditions check is completed, the furnace control system 200 transmits a signal to the inducer blower 120 to energize the inducer blower 120. The furnace control system 200 may check the pressure within the furnace system 100 using the pressure sensor 130 to ensure an adequate supply of fresh (i.e., uncombusted) air is being supplied into the combustion chamber 102. In the example embodiment, the furnace control system 200 outputs a signal to the pressure sensor 130 to confirm that the open/close switch of the pressure sensor 130 is in the closed position.

The furnace control system 200 then outputs a signal to the main burner valve 116 to open the main burner valve 116 and enable the supply of fuel gas to the burner assembly 108. Before, during, or after opening the main burner valve 116, the furnace control system 200 outputs a signal to the ignition device 112 to energize the ignition device 112 and ignite the air/fuel mixture within the combustion chamber 102. Where the ignition device 112 is a hot surface ignitor, such as in the example embodiment, the furnace control system 200 may energize the ignition device 112 prior to energizing the main burner valve 116 to allow the ignition device 112 sufficient time to heat up to a temperature sufficient to initiate combustion. Where the ignition device 112 is an intermittent pilot, the furnace control system 200 energizes the pilot burner valve (not shown) and ignites the intermittent pilot prior to energizing the main burner valve 116.

The furnace control system 200 may then check whether flame initiation was successful via the flame sensor 136. For example, the flame sensor 136 may output a signal to the furnace control system 200 indicating the presence of a flame in the combustion chamber 102. If no flame is detected by flame sensor 136, the furnace control system 200 may de-energize one or more of the main burner valve 116, the ignition device 112, and the inducer blower 120, and reattempt to initiate combustion within the combustion chamber 102. If the flame sensor 136 detects the presence of a flame, the furnace control system 200 energizes the air circulator 106 to circulate air across the heat exchanger 104 and into the temperature controlled environment via outlet 138.

When the call for heat has been satisfied (i.e., when the detected temperature in the temperature controlled environment is equal to or greater than a pre-determined temperature limit), the thermostat 128 outputs a signal to the furnace control system 200 to indicate the call for heat has been satisfied. The furnace control system 200 then de-energizes the main burner valve 116, the inducer blower 120, the ignition device 112, and the air circulator 106. The furnace control system 200 may maintain the inducer blower 120 and/or the air circulator 106 in an energized state for a preset delay period after receiving the signal to terminate the heat cycle.

Figure 3:
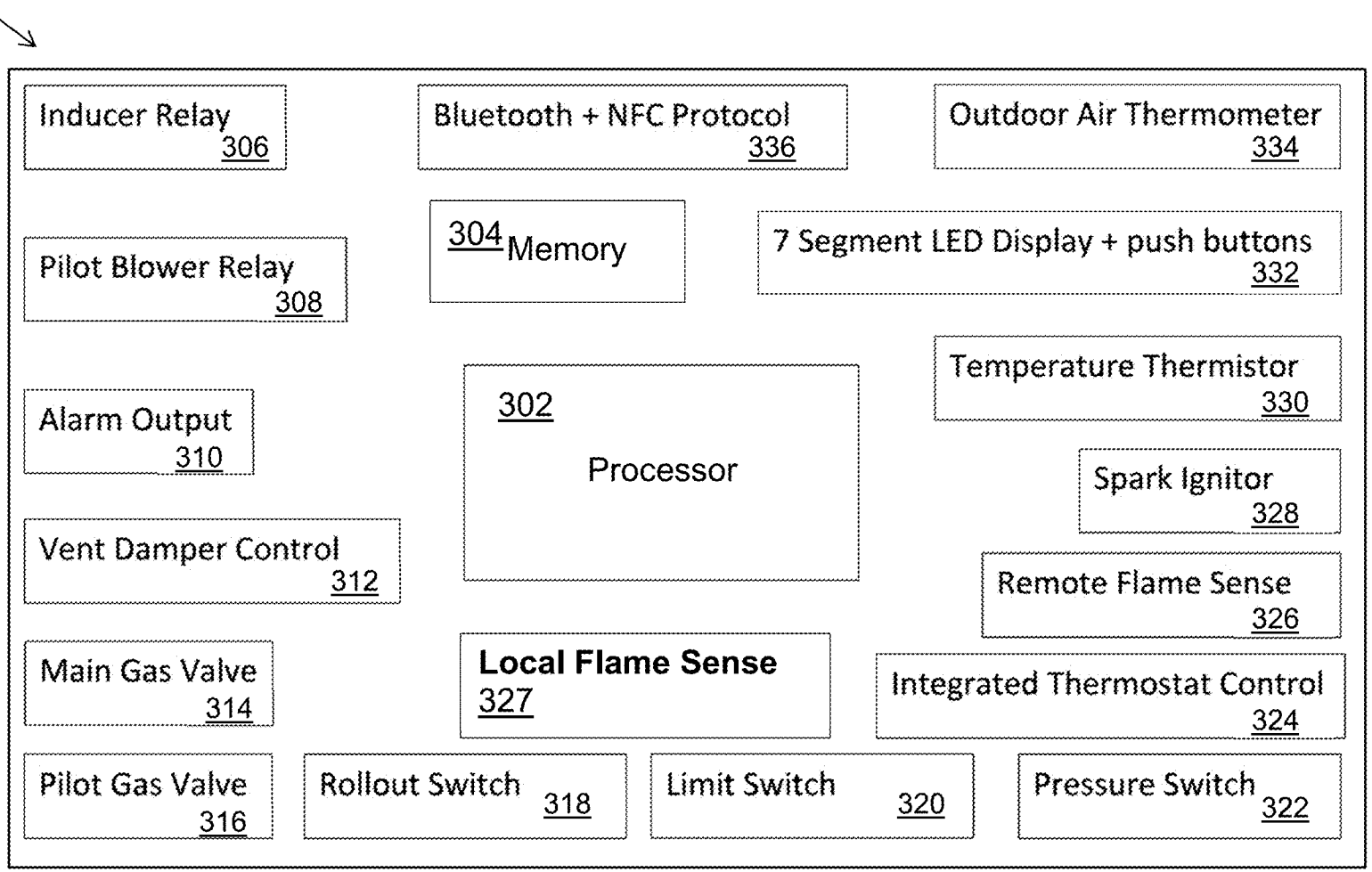
FIG. 3 is a functional block diagram of the spark ignition controller of FIG. 1.

FIG. 3 is a functional block diagram of an example spark ignition controller 300 for use in the furnace control system 200. The functions represented by the functional blocks of the controller 300 in FIG. 3 may be implemented in hardware, software, firmware, or a combination of hardware, software, and/or firmware. The spark ignition controller 300 is selectively configurable by an operator to operate an intermittent pilot (IP) or a direct spark ignition (DSI) ignition module 112. Other embodiments include different components, additional components, and/or do not include all components shown in FIG. 3.

The spark ignition controller 300 includes a processor 302 configured for executing instructions. In some embodiments, executable instructions are stored in the memory 304. The processor 302 may include one or more processing units (e.g., in a multi-core configuration). The memory 304 is any device allowing information such as executable instructions and/or other data to be stored and retrieved. The memory 304 may include one or more computer-readable media. The memory 304 stores computer-readable instructions for control of the system 100 as described herein. The term processor, as used herein, refers to central processing units, microprocessors, microcontrollers, reduced instruction set circuits (RISC), application specific integrated circuits (ASIC), logic circuits, and any other circuit or processor capable of executing the functions described herein. The above are examples only, and are thus not intended to limit in any way the definition and/or meaning of the term "processor." The memory may include, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are example only, and are thus not limiting as to the types of memory usable for storage of data, instructions, and/or a computer program.

The processor 302 is communicatively coupled to the other components of the spark ignition controller 300. The other components include an inducer relay 306, a pilot blower relay 308, an alarm output 310, a vent damper control port 312, a main gas valve port 314, a pilot gas valve port 316, a rollout switch port 318, a limit switch port 320, a pressure switch port 322, an integrated thermostat control 324, a remote flame sense port 326, a local flame sense 327, a temperature thermistor 330, a user interface 332, an outdoor air thermometer port 334, and a communication interface 336.

The inducer relay 306 is connected to the inducer blower 110 and is used by the processor 302 to control the inducer blower 110. The pilot blower relay 308 is connected to circulator 106 and is used by the processor 302 to control the circulator 106. The alarm output 310 is connected to an external alarm (such as a speaker, siren, flashing light, or the like, and is used by the processor 302 to sound an alarm to indicate an error in the system 100. The vent damper control port 312 couples the processor to a vent damper to allow the processor 302 to control the vent damper. In some embodiments, when a vent damper is present, the vent damper connector detects that a damper (from the unit's factory wiring) is plugged into it, and after one ignition cycle, the board will blow an internal fuse. In other embodiments, the board blows the internal fuse after more than one ignition cycle, such as after five ignition cycles. Other embodiments blow the internal fuse after any suitable number of ignition cycles. The board must always then be used with a vent damper for proper operation. A jumper plug may be connected to the vent damper control port 312 to tell the processor that a vent damper is not present in the system. For example, the jumper plug may short two pins of the connector 312 together to tell the processor that a vent damper is not present. The processor 302 controls the main burner valve 116 through the main gas valve port 314, and controls the pilot burner valve (when used) through the pilot gas valve port 316. The rollout switch port 318 connects the processor 302 to a rollout switch. The processor 302 is coupled to a limit switch through the limit switch port 320. A pressure switch (e.g., pressure sensor 130) is coupled to the processor 302 through the pressure switch port 322. The integrated thermostat control 324 communicates with the temperature thermistor 330 to function as a thermostat for the system 100 without the need for an external thermostat. Generally, the integrated thermostat control 324 reads the temperature from the thermistor 330, compares it to a setpoint temperature, issues a call for heat when the temperature is below the setpoint temperature, and cancels the call for heat when the temperature is above the setpoint temperature. This allows the spark ignition controller 300 to be used as a standalone, complete control system for some gas powered appliances, such as space heaters and the like. The remote flame sense port 326 couples the processor 302 to the flame sensor 136. The local flame sense 327 may be used instead of the remote flame sense port 326. In the local flame sense 327, the flame is sensed through the spark probe (e.g. ignition device 112), rather than through the flame sensor 136, and may be used, for example, in systems that do not include the flame sensor 136. The outdoor air thermometer port 334 can be coupled to an outdoor thermometer to provide the processor 302 with the air temperature outside of an enclosure (e.g., a housing, a building, or the like) enclosing the system 100 and/or the spark ignition controller 300. By plugging in an optional outdoor air temperature thermistor to port 334, the spark ignition controller 300 is enabled to create its own "W" call for heat. When enabled, the "W" input terminal would then be ignored, and spark ignition controller 300 would create its own call for heat based on measured space temperature from the OAT.

The user interface 332 includes a seven segment LED display and a plurality of push buttons to allow a user to configure the spark ignition controller 300. That is, the user can use the push buttons to navigate through settings (as displayed on the seven segment display), select which feature the user desires to set, navigate through the options for the selected setting (e.g., "on" or "off"), and select the desired setting.

The communication interface 336 allows the user to wirelessly and remotely communicate with the spark ignition controller 300 using mobile device 144. In the example embodiment, the communication interface 336 includes Bluetooth and near field communication (NFC) modules, thereby allowing the user's mobile device 144 to communicate with the spark ignition controller 300 using NFC or Bluetooth communication. Other embodiments include only one of NFC or Bluetooth communication modules. Still other embodiments include one or more other communications modules, such as a Wi-Fi module, in addition or instead of the NFC and/or Bluetooth modules. When the mobile device 144 is communicatively connected to spark ignition controller 300, the user can use a program or application on the mobile device 144 to configure the spark ignition controller 300, rather than needing to use the user interface 332. Moreover, the communication interface is used, in some embodiments, for communicating with remote components of the system 100. For example, a Bluetooth enabled temperature sensor may be communicatively coupled to the spark ignition controller 300 through the communication interface 336 or a portion of the communication interface 336.

In some embodiments, multiple spark ignition controllers 300 may be communicatively coupled together in a mesh network using the communication interface 336. Each spark ignition controller 300 can communicate with one or more nearby spark ignition controllers 300 (e.g., those that are within range of the particular communication interface 336) to form a mesh network, which allows communication to all other spark ignition controllers 300 from any one of the spark ignition controller 300 (even though the spark ignition controllers 300 may be too far apart for direct communication between all of the spark ignition controllers 300 without a mesh network). The mesh network may be useful, for example, in environments including multiple space apart gas powered appliances (e.g., gas space heaters), such as outdoor restaurant/bar seating areas, agricultural facilities, farm buildings, warehouses, factories, and the like. Once the spark ignition controllers 300 are connected in a mesh network, a user can establish a communication link with one of the spark ignition controllers 300 and program, configure, update, etc. all of the spark ignition controllers 300 in the mesh network without needing to move to each spark ignition controller 300 or repeat the programming, configuring, updating, etc. multiple times. Moreover, the user can program, configure, update, etc. a particular one or group of spark ignition controllers 300 from one spark ignition controller 300 through the mesh network.

The spark ignition controller 300 can be used to control a system with an IP ignition device 112 or a DSI device 112. Two aspects of the spark ignition controller 300 contribute to this capability. The first aspect is the inclusion of controls and interfaces for components of both types of systems. That is, the memory 304 stores control values, timings, and/or algorithms for controlling both types of systems, and the spark ignition controller 300 includes physical connections and component needed to control both types of systems. For example, the spark ignition controller 300 includes both main gas valve port 314 and pilot gas valve port 316. Both ports 314 and 316 are needed for a system using an IP ignition device 112, but only the main gas valve port is used in a system using a DSI ignition device 112. Further, for an IP system, the controller 300 has the capability to control a vent damper and a rollout switch, which are not needed in DSI. To control a DSI system, the controller 300 has the capability to control the inducer, pressure switch, or postpurge options, which are not applicable in IP system. The spark ignition controller 300 includes at least one connector (e.g., a pin of a multi-pin connector, a terminal, an entire connector, or the like) only used in an IP system (e.g., a connector for the pilot valve) and at least one connector only used in a DSI system (e.g., a connector for the inducer).

The second aspect allows the spark ignition controller's controls to be configured by the user to operate a system 100 with an intermittent pilot ignition device 112 or a direct spark ignition device 112 using either the application on the mobile device 144 or using the user interface 332. Whichever technique is used, the user selects whether the spark ignition controller 300 is controlling a system with an IP ignition device 112 or a DSI ignition device 112. Different ignition timings and controls are used for each of these two types of ignition devices 112. Default controls (such as for ignition timings) are selected by the processor 302 in response to the selection of the type of ignition device 112. In some embodiments, the default settings may be changed individually by the user. In some embodiments, the settings may be changed as a group of settings based on additional details of the type of system (e.g., by selecting a manufacturer of the system 100 or one or more components of the system).

Thus, when the user selects an IP based system, the spark ignition controller 300 ignites the burner 108 by first opening the pilot valve using the pilot gas valve port 316 and ignites the pilot using a pilot ignition device (not shown). The spark ignition controller 300 then confirms that the pilot has been lit, e.g., using remote flame sense 326. Next, the spark ignition controller 300 opens the main gas valve 116 using main gas valve port 314 and the already lit pilot ignites the main burner 108. The spark ignition controller 300 may then prove ignition of the main burner 108 using the remote flame sense 326.

When the user instead chooses a DSI based system, the spark ignition controller 300 ignites the burner 108 by first opening the main gas valve 116 using main gas valve port 314, and directly igniting the main burner 108 using ignition device 112. The spark ignition controller 300 may then prove ignition of the main burner 108 using the remote flame sense 326.

Figure 4:
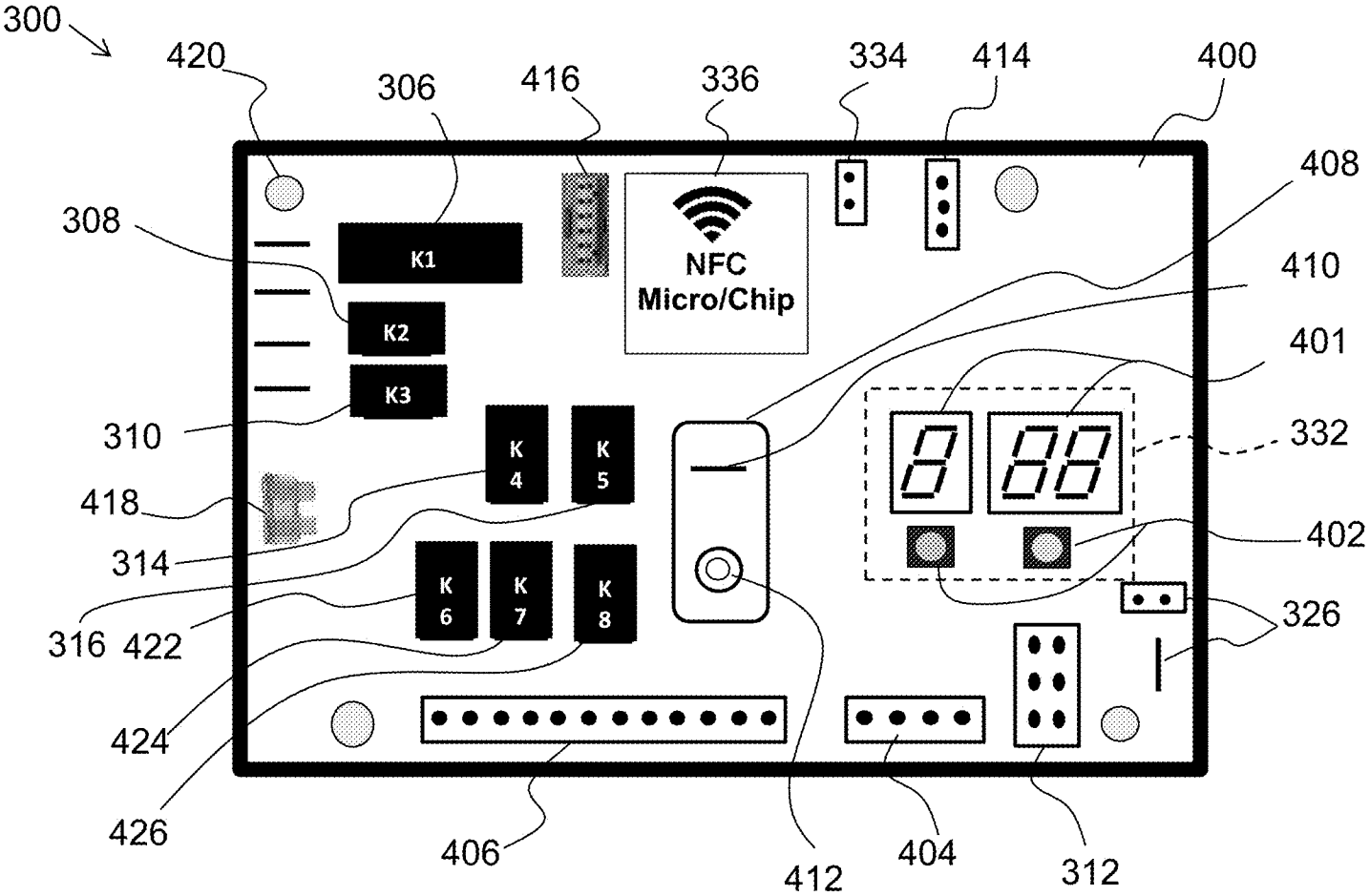
FIG. 4 is an example implementation of the spark ignition controller of FIG. 3.
Figure 5:
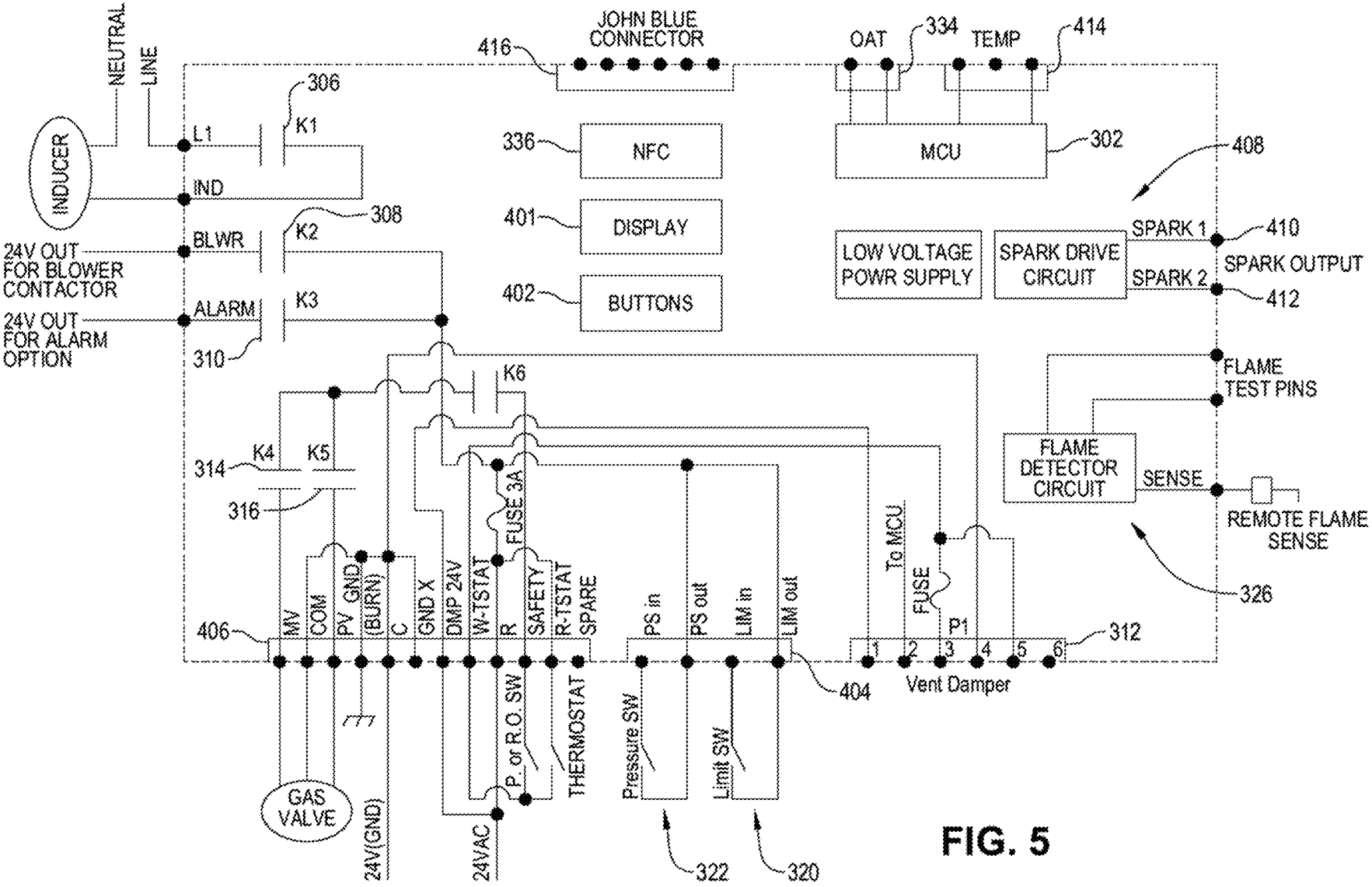
FIG. 5 is an example wiring diagram of the implementation in FIG. 4.

FIG. 4 is an example implementation of the spark ignition controller 300 on a circuit board 400. FIG. 5 is a wiring diagram for the implementation shown in FIG. 4.

In this implementation, the user interface 332 includes seven segment displays 401 and buttons 402. Connector 404 includes connections for the limit switch port 320 and the pressure switch port 322. Connector 406 includes connections for the main gas valve 314 (MV in FIG. 5), the pilot gas valve 316 (PV in FIG. 5), ground/common (GND/COM), and twenty-four volt AC power (24 VAC). The spark ignition controller 300 includes a fuse 418 in this implementation. Other implementations of the spark ignition controller 300 may omit the fuse 418. Mounting holes 420 allow the circuit board 400 to be mounted in the system 100.

A power relay 422 allows the spark ignition controller 300 to detect whether the controller is receiving constant 24V power (i.e., there is a 24V wire coming off the transformer and plugging directly into the 24V terminal on spark ignition controller 300) or if the spark ignition controller 300 only receives power only on a call for heat. The power relay 422 will be closed if the spark ignition controller 300 only receives 24V power on a call for heat, and will open when the spark ignition controller 300 receives constant 24V power. This allows the spark ignition controller 300 to operate with both types of systems and only open the gas valve during a call for heat.

A PSW/RO relay 424 is useful for applications that send 24V power through the PSW/RO terminal before the gas valve relay(s). This relay 424 will close when the application is using the PSW/RO to feed the gas valve. This relay 424 will open when this is not the case (in this case, TH-W will feed the gas valve).

The SAFETY connection is used for safety operations. For systems selected and set up as IP, the user can enable a separate rollout switch as a direct input. The rollout switch is wired to the terminal labeled SAFETY. The rollout switch (a normally closed set of contacts) is positioned to detect flames rolling out of the combustion chamber. If rollout occurs, the switch contacts open and the spark ignition controller 300 goes into a lockout condition, closing the main and pilot valves so that the system is not allowed to function. For systems selected and set up as DSI, the user can enable an inducer+pressure switch option. The pressure switch is wired to the spark ignition controller 300 at the terminal labeled SAFETY. The pressure switch is a normally open set of contacts that close with the inducer running. Relay 426 is a safety/redundant relay.

The vent damper control port 312 is implemented as a 6-pin connector. The remote flame sense port 326 is implemented as a 2-pin flame test connector and a remote flame sense spade. A spark output 408 includes a spark drive circuit (FIG. 5), a first spark output connector 410, and a second spark output connector 412. The spark drive circuit produces the output to activate the spark ignitor (whether for igniting the gas directly in a DSI system or igniting the pilot in an IP system). The output is coupled to both output connectors 410 and 412. The first spark output connector 410 and the second spark output connector 412 are different types of connectors, thereby allowing the spark output 408 to be connected to systems using different types of connectors for the spark ignitor. The unused connector 410, 412 will typically be covered with an insulating safety cover. In the example implementation, the first spark output connector 410 is a ¼ inch spade connector, and the second spark output connector 412 is a "rajah" plug. Other implementations may use different types of output connectors and/or may include more than two spark output connectors.

Connector 414 is a 3-pin plug for receiving a temperature, such as an indoor air temperature. Connector 416 is a 6-pin "John Blue" connector. Add-on modules may be connected to the spark ignition controller 300 through the connector 416 to add additional functionality to the spark ignition controller 300. For example, in the implementation shown in FIGS. 4 and 5, the spark ignition controller 300 does not include a Bluetooth module on the circuit board 400. A separate Bluetooth module can be connected to the spark ignition controller 300 through the connector 416. Alternatively, a Wi-Fi module, Ethernet module, or any other suitable external module may be connected to the spark ignition controller 300 via the connector 416.

Example embodiments of gas-powered furnace systems and furnace controllers are described above in detail. The system and controller are not limited to the specific embodiments described herein, but rather, components of the system and controller may be used independently and separately from other components described herein.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A spark ignition controller for use in a gas powered heater, the spark ignition controller comprising:
- a circuit board;
- a plurality of connectors mounted on the circuit board;
- a local temperature sensor mounted on the circuit board; and
- a processor mounted on the circuit board and programmed to:
  - receive a user selection to configure the spark ignition controller to control an intermittent pilot (IP) system or a direct spark ignition (DSI) system;
  - initiate operation of the gas powered heater to generate heat based on a temperature from the local temperature sensor without receiving a call for heat;
  - control operation of the gas powered heater using, in part, at least one connector of the plurality of connectors and IP system control settings when the user selection is to configure the controller to control the IP system; and
  - control operation of the gas powered heater using, in part, at least one connector of the plurality of connectors and DSI system control settings when the user selection is to configure the controller to control the DSI system.

2. The spark ignition controller of claim 1, further comprising a communication interface for communication with a mobile device.

3. The spark ignition controller of claim 2, wherein the communication interface comprises a near field communication (NFC) module.

4. The spark ignition controller of claim 3, wherein the communication interface further comprises a Bluetooth module.

5. The spark ignition controller of claim 2, wherein the communication interface comprises a Bluetooth module.

6. The spark ignition controller of claim 2, wherein the user selection to configure the spark ignition controller to control the DSI system or to control the IP system is received from the mobile device via the communication interface.

7. The spark ignition controller of claim 1, further comprising at least one input device connected to the circuit board, and wherein the user selection to configure the spark ignition controller to control the DSI system or to control the IP system is received from a user via the at least one input device.

8. The spark ignition controller of claim 7, wherein the at least one input device comprises at least one button.

9. The spark ignition controller of claim 8, further comprising at least one seven segment display connected to the circuit board, wherein the processor is programmed to display an indication of the user selection using the at least one seven segment display when the user enters the user selection using the at least one button.

10. The spark ignition controller of claim 1, wherein the processor is further programmed to operate the gas powered heater to generate heat based on a temperature measurement from the local temperature sensor mounted on the circuit board and a stored temperature setpoint.

11. The spark ignition controller of claim 10, wherein the local temperature sensor mounted on the circuit board comprises a thermistor.

12. A spark ignition controller for use in a gas powered heater, the spark ignition controller comprising:
- a circuit board;
- a plurality of connectors mounted on the circuit board;
- a connection for communication with a remote thermostat; and
- a processor mounted on the circuit board and programmed to:
  - receive a user selection to configure the spark ignition controller to control an intermittent pilot (IP) system or a direct spark ignition (DSI) system;
  - initiate operation of the gas powered heater to generate heat in response to a call for heat received from the remote thermostat;
  - control operation of the gas powered heater using, in part, at least one connector of the plurality of connectors and IP system control settings when the user selection is to configure the controller to control the IP system; and
  - control operation of the gas powered heater using, in part, at least one connector of the plurality of connectors and DSI system control settings when the user selection is to configure the controller to control the DSI system.

13. The spark ignition controller of claim 12, further comprising a communication interface for communication with a mobile device.

14. The spark ignition controller of claim 13, wherein the communication interface comprises a near field communication (NFC) module.

15. The spark ignition controller of claim 14, wherein the communication interface further comprises a Bluetooth module.

16. The spark ignition controller of claim 13, wherein the communication interface comprises a Bluetooth module.

17. The spark ignition controller of claim 13, wherein the user selection to configure the spark ignition controller to control the DSI system or to control the IP system is received from the mobile device via the communication interface.

18. The spark ignition controller of claim 12, further comprising at least one input device connected to the circuit board, and wherein the user selection to configure the spark ignition controller to control the DSI system or to control the IP system is received from a user via the at least one input device.

19. The spark ignition controller of claim 18, wherein the at least one input device comprises at least one button.

20. The spark ignition controller of claim 19, further comprising at least one seven segment display connected to the circuit board, wherein the processor is programmed to display an indication of the user selection using the at least one seven segment display when the user enters the user selection using the at least one button.

* * * * *